US006645348B2

(12) United States Patent
Kumamoto et al.

(10) Patent No.: US 6,645,348 B2
(45) Date of Patent: Nov. 11, 2003

(54) METHOD FOR PRODUCING PULP MOLDED ARTICLE

(75) Inventors: Yoshiaki Kumamoto, Tochigi (JP); Shinji Otakura, Tochigi (JP); Kenichi Otani, Tochigi (JP); Shingo Odajima, Tochigi (JP); Tokuo Tsuura, Tochigi (JP)

(73) Assignee: Kao Corporation, Tokyo (JP)

( * ) Notice: Subject to any disclaimer, the term of this patent is extended or adjusted under 35 U.S.C. 154(b) by 9 days.

(21) Appl. No.: 10/212,723

(22) Filed: Aug. 7, 2002

(65) Prior Publication Data

US 2002/0189776 A1 Dec. 19, 2002

Related U.S. Application Data

(62) Division of application No. 09/622,039, filed as application No. PCT/JP99/00773 on Feb. 22, 1999, now Pat. No. 6,468,398.

(30) Foreign Application Priority Data

Feb. 23, 1998 (JP) ..... 10-40700
Dec. 25, 1998 (JP) ..... 10-371578

(51) Int. Cl.[7] ..... D21J 7/00
(52) U.S. Cl. ..... 162/220; 162/223; 162/228; 264/86
(58) Field of Search ..... 162/218, 220–224, 162/226–228, 387–390, 395–397, 401, 405, 407–409, 411; 425/84, 388, 529, 530; 419/36; 249/65, 113; 264/86, 87

(56) References Cited

U.S. PATENT DOCUMENTS 398,397 A * 2/1889 Howard ..... 162/401
867,389 A * 10/1907 Lorenz ..... 162/219
2,116,198 A * 5/1938 Hawley ..... 162/223
2,800,945 A * 7/1957 Schilling ..... 162/116
RE24,860 E * 8/1960 Kyle ..... 162/219
2,961,043 A * 11/1960 Hicks ..... 162/401
4,683,028 A * 7/1987 Waller et al. ..... 162/275
4,900,487 A * 2/1990 Lalloz et al. ..... 264/45.2
5,039,465 A * 8/1991 Freeman et al. ..... 264/86
6,454,906 B1 9/2002 Nonomura et al. ..... 162/220
6,461,480 B1 10/2002 Otakura et al. ..... 162/220

FOREIGN PATENT DOCUMENTS

JP 51-34002 9/1976
JP 55-71900 5/1980

OTHER PUBLICATIONS

T. Goto, Public Relations Department, Kao Corporation, 4 pages, "Paper–Bottle Molding System", Oct. 25, 2000 (with English Translation).

U.S. patent application Ser. No. 09/508,540, Otsuji et al., filed Apr. 07, 2000.

U.S. patent application Ser. No. 09/673,667, Kumamoto et al., filed Jan. 05, 2001.

U.S. patent application Ser. No. 09/713,230, Nonomura et al., filed Nov. 16, 2000.

U.S. patent application Ser. No. 09/868,040, Otani et al., filed Jul. 23, 2001.

U.S. patent application Ser. No. 09/889,566, Nonomura, filed Aug. 09, 2001.

(List continued on next page.)

*Primary Examiner*—Steven P. Griffin
*Assistant Examiner*—Eric Hug
(74) *Attorney, Agent, or Firm*—Oblon, Spivak, McClelland, Maier & Neustadt, P.C.

(57) ABSTRACT

Pulp deposited bodies (7 and 8) are formed on the surfaces (2*a* and 3*a*) of a set of splits (2 and 3) of a papermaking mold, each split having a plurality of interconnecting holes connecting the outside to the inside thereof, and the splits (2 and 3) are mated to join the pulp deposited bodies (7 and 8).

35 Claims, 5 Drawing Sheets

OTHER PUBLICATIONS

U.S. patent application Ser. No. 09/926,690, Otani et al., filed Dec. 03, 2001.
U.S. patent application Ser. No. 10/110,715, Tojo et al., filed Apr. 15, 2002.
U.S. patent application Ser. No. 10/182,743, Nonomura et al., filed Aug. 15, 2002.
U.S. patent application Ser. No. 10/212,723, Kumamoto et al., filed Aug. 07, 2002.
U.S. patent application Ser. No. 10/204,859, Otani et al., filed Aug. 26, 2002.
U.S. patent application Ser. No. 10/335,153, Kumamoto et al., filed Jan. 02, 2003.
U.S. patent application Ser. No. 09/622,043, filed Oct. 10, 2000, allowed.
U.S. patent application Ser. No. 09/885,982, filed Jun. 22, 2001, allowed.
U.S. patent application Ser. No. 10/212,723, filed Aug. 07, 2002, pending.
U.S. patent application Ser. No. 10/212,723, Kumamoto, et al., filed Aug. 7, 2002.
U.S. patent application Ser. No. 10/365,453, Kumamoto, et al., filed Feb. 13, 2003.

* cited by examiner 11
12
21
22
23
22a
23a
30
A
q

METHOD FOR PRODUCING PULP MOLDED ARTICLE

This application is a Division of application Ser. No. 09/622,039 now U.S. Pat. No. 6,468,398 Filed on Aug. 23, 2000, which was originally filed as PCT/JP99/00773, filed on Feb. 22, 1999.

TECHNICAL FIELD

The present invention relates to a method for producing pulp molded articles suitable to keep things in such as powders or liquids and to pulp molded hollow containers.

BACKGROUND ART

Plastics are used as general materials of packaging containers, for example, those with a lid and bottles, for their excellent molding properties and productivity. However, because plastic containers involve various problems associated with waste disposal, pulp molded containers formed by pulp molding have been attracting attention as substitutes for plastic containers. Pulp molded containers are not only easy to dispose of but economical because they can be manufactured by using regenerated paper.

Pulp molded containers having the above-described characteristics are produced by, for example, immersing a papermaking net shaped in conformity to the shape of a molded article in a pulp slurry, evacuating water contained in the slurry through the papermaking net by means of a vacuum pump, etc. to deposit pulp fiber on the surface of the net, and transferring the net to a drying oven where the pulp fiber is dried to obtain a pulp molded container as disclosed in Japanese Patent Publication No. 51-34002.

In the above method, however, it is difficult to clear the papermaking net of the residual fiber attached thereto. In addition, since the pulp fiber clings to the papermaking net, making it difficult to release and take out the molded article from the net after papermaking and drying, which imposes restrictions on product design.

Japanese Patent Application Laid-Open No. 71900/80 discloses a method for producing a pulp molded article which comprises covering the surface of a mold with a continuous flat porous woven fabric, depositing pulp fiber on the porous woven fabric in conformity to the configuration of the mold, dehydrating and drying the pulp deposited body, and releasing the pulp molded article from the porous woven fabric and the mold.

According to the above method, since the porous woven fabric is merely brought into contact with the mold surface, it is difficult to conform the porous woven fabric to the contour of the mold in case where a product having a depth of 60 mm or more or a product having such a complicated shape as having projections, different levels, etc. is to be molded. Further, the method is costly because the mechanism for transferring the mold and the porous woven fabric used in the above method is complicated and requires large-sized equipment.

Accordingly, an object of the present invention is to provide a method for producing a pulp molded article by which a pulp molded article having a complicated shape with a uniform thickness can be manufactured without requiring large-sized equipment and with ease in removing the molded article from the mold and to provide a pulp molded hollow container.

DISCLOSURE OF THE INVENTION

The present invention has achieved the above object by providing a method for producing a pulp molded article which is characterized by comprising the steps of depositing pulp fiber on the surfaces of a set of splits for papermaking having a plurality of interconnecting holes connecting the outside and the inside to form a pulp deposited body on each split and closing the splits to join the pulp deposited bodies together.

BRIEF DESCRIPTION OF THE DRAWINGS

FIG. 7(*c*) shows joining pulp deposited bodies the joint edges of which project outward.

BEST MODE FOR CARRYING OUT THE INVENTION

Figure 1:
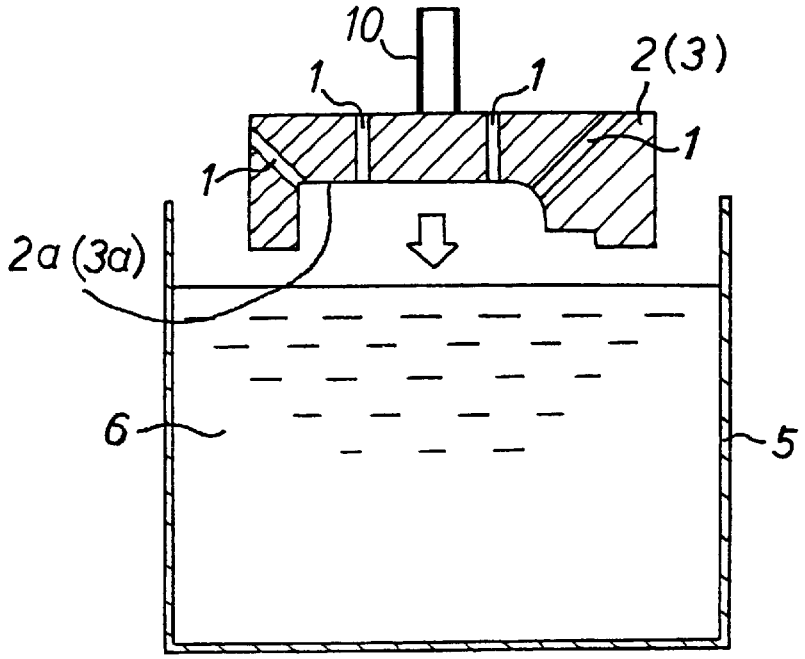
FIG. 1 is a cross sectional view showing a split which is about being immersed in a pulp slurry.
Figure 2:
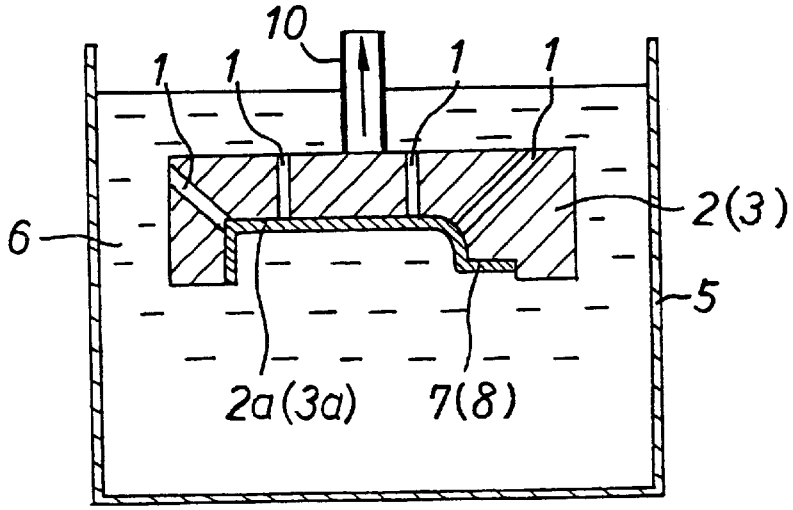
FIG. 2 is a cross sectional view showing papermaking with the split.
Figure 3:
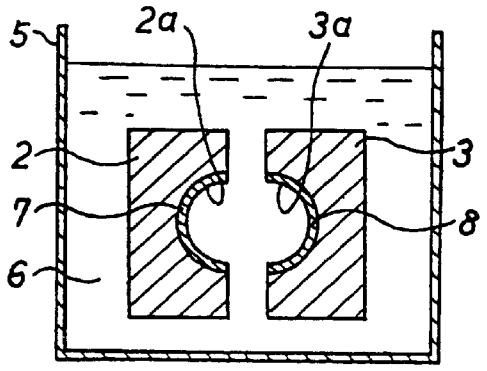
FIG. 3 illustrates closure of a set of splits in a pulp slurry, wherein FIG. 3(*a*) is a transverse section showing the state before split mold closure, and FIG. 3(*b*) is a transverse section showing the state after split mold closure.
Figure 3:
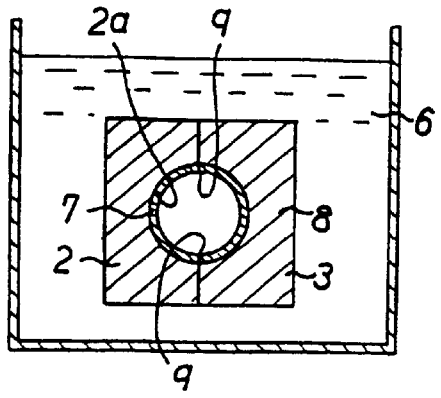
Figure 4:
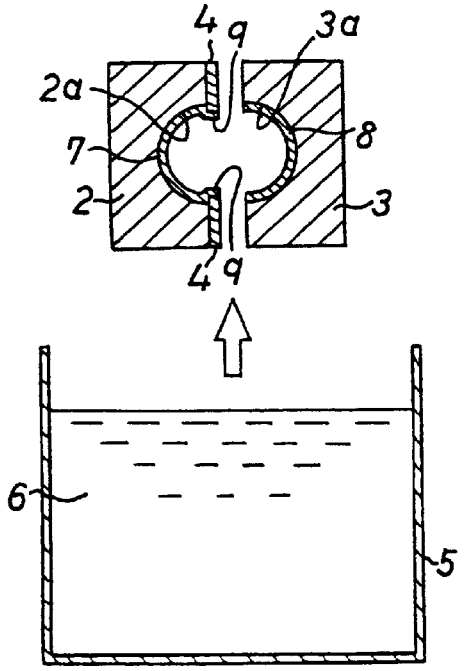
FIG. 4 shows closure of a set of splits after they are taken out of a pulp slurry, wherein FIG. 4(*a*) is a transverse section showing the state before split mold closure, and FIG. 4(*b*) is a transverse section showing the state after split mold closure.
Figure 4:
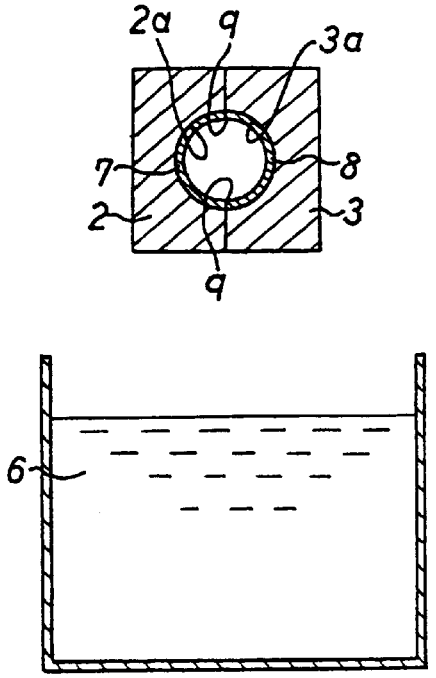
Figure 5:
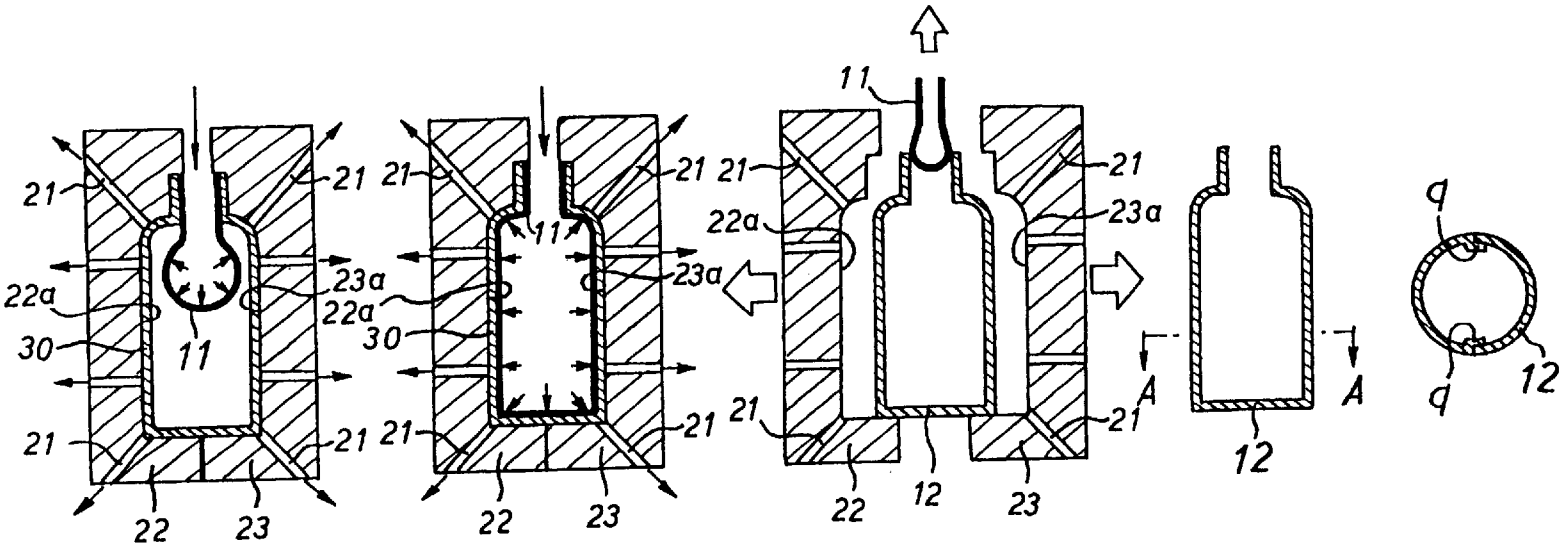
FIG. 5(*a*), FIG. 5(*b*), FIG. 5(*c*), FIG. 5(*d*) and FIG. 5(*e*) are cross sectional views showing, in sequence, the steps of inserting a hollow elastic body into a preform of a hollow container, inflating the elastic body, and pressing the hollow container preform onto the inner wall of a heating mold by the inflated elastic body to dry the hollow container preform to produce a pulp molded hollow container.

A specific first embodiment of the present invention will be described in detail with reference to the accompanying drawings. FIG. 1 is a cross sectional view showing a split mold which is about being immersed in a pulp slurry. FIG. 2 is a cross sectional view showing papermaking with the split mold. FIG. 3(*a*) and FIG. 4(*a*) are each a transverse section showing the state before split mold closure. FIG. 3(*b*) and FIG. 4(*b*) are each a transverse section showing the state after split mold closure. FIG. 5 shows cross sections showing, in sequence, the steps of inserting a hollow elastic body into a hollow container preform, inflating the elastic body, and pressing the hollow container preform onto the inner wall of a heating mold by the inflated elastic body to dry the hollow container preform thereby to produce a pulp molded hollow container.

The method for producing a pulp molded hollow container according to the present embodiment is characterized by comprising immersing each of a set of splits having a plurality of interconnecting holes connecting the outside and the inside of the split in a pulp slurry, evacuating water contained in the slurry through the interconnecting holes to deposit pulp fiber on the inner side of the split to form a pulp deposited body, and closing the set of splits to join the pulp deposited bodies together.

The method for producing a pulp molded hollow container according to the present embodiment will further be illustrated in greater detail by way of the drawings. First of all, a set of splits 2 and 3 (illustration of the split 3 is omitted in FIG. 1) having a plurality of interconnecting holes 1 which connect the outer side of the split to the cavity side are prepared as shown in FIG. 1. In this embodiment, the inner sides 2*a* and 3*a* of the splits 2 and 3 are shaped to the contour of a container. While not shown, every interconnecting hole 1 is connected to a suction pipe 10 so that the cavity side may be evacuated through the suction pipe 10 by means of a vacuum pump, etc.

Then, a pair of splits 2 and 3 are each immersed in a pulp slurry 6 in a container 5 as shown in FIG. 2. The splits 2 and 3 making a set may be immersed in the pulp slurry 6 either simultaneously or separately. The pulp slurry is prepared by dispersing pulp fiber in water. The pulp fiber concentration is preferably more than 0 wt % and not more than 6.0 wt %, still preferably from 0.1 to 3.0 wt %. The pulp fiber is preferably wood pulp, such as soft wood pulp and hard wood pulp, or non-wood pulp, such as bamboo and straw. The pulp fiber preferably has a length of 0.1 to 10.0 mm and a thickness of 0.01 to 0.10 mm.

The split is evacuated through the interconnecting holes 1 to deposit pulp fiber on the inner side 2*a* or 3*a* of each split to form a pulp deposited body 7 or 8 thereon as shown in FIG. 3(*a*). The papermaking time is preferably 2 to 10 seconds. The degree of vacuum is preferably 100 to 600 Torr from the standpoint of the surface properties of a molded article and processability of the pulp deposited body 7 or 8. The thickness of the pulp deposited body 7 or 8 is preferably 0.5 to 10.0 mm.

Immediately after the pulp deposited bodies 7 and 8 are formed, the set of the splits 2 and 3 are butted to each other in the pulp slurry 6 to join the pulp deposited bodies 7 and 8 as shown in FIG. 3(*b*). By this joining method, the resulting hollow container has a uniform thickness with no differences in level at the area, in the inner side thereof, corresponding to the joint part 9. The splits 2 and 3 can be closed while evacuating to facilitate the joining and to provide a hollow container with a more uniform thickness.

Closure of the splits 2 and 3 can also be performed as follows. As shown in FIG. 4(*a*), the splits 2 and 3 having pulp deposited bodies 7 and 8 formed on the inner sides 2*a* and 3*a*, respectively, are taken out of the pulp slurry 6. One of the splits, e.g., the split 2, has a pair of removable auxiliary molds 4 and 4 at the parts mating with the other split 3 as shown in FIG. 4(*a*). The auxiliary molds 4 and 4 serve to form joint parts via which the pulp deposited body is to be joined with the other pulp deposited body in the subsequent step of joining. The edge of each auxiliary mold 4 slightly projects over the inner surface 2*a* of the split having the cavity shape. Since pulp fiber is deposited on the edge of the auxiliary molds 4 and 4, too, an overlap (joint part) 9 projecting inward is formed on the mating edge of the pulp deposited body 7 as shown in FIG. 4(*a*).

The splits 2 and 3 taken out of the pulp slurry 6 are closed as shown in FIG. 4(*b*) to join the pulp deposited bodies 7 and 8. Prior to closure of the splits 2 and 3, the auxiliary molds 4 and 4 are removed thereby leaving the joint part 9 at the mating edge of the pulp deposited body 7. On joining the pulp deposited bodies 7 and 8, the joint part 9 and the mating edge of the other pulp deposited body 8 are overlapped with each other. It is preferred that the water content of the joint part 9 be 40 to 95 wt %, particularly 60 to 90 wt %, for the ease of joining the pulp deposited bodies 7 and 8.

After the pulp deposited bodies 7 and 8 are thus joined, the splits 2 and 3 are opened, and the wet hollow container preform is taken out. The hollow container preform is then subjected to the step of heat drying. In the heat drying step, the wet hollow container preform (hereinafter simply referred to as a preform) 30 is set in a pair of halves 22 and 23 of a heating mold, which, on closure, form a cavity corresponding to the contour of a desired hollow container as shown in FIG. 5(*a*). The heating mold 22, 23 has a plurality of interconnecting holes 21 interconnecting the outside and the cavity. An elastic and stretchable hollow pressing member 11 is inserted into the inside of the preform 30 while the inside of the heating mold 22, 23 being evacuated as shown in FIG. 5(*a*). The pressing member 11 is preferably made of natural rubber, synthetic rubber, thermoplastic elastomers, and the like which are excellent in tensile strength, impact resilience and stretchability. Most preferably, it is made of urethane, fluororubber, silicone rubber, etc.

A pressurizing fluid is fed into the pressing member 11 to inflate the pressing member 11 thereby to press the preform 30 onto the inner sides 22*a* and 23*a* of the heating mold by the inflated pressing member 11 as illustrated in FIG. 5(*b*). As a result, the preform 30 is pressed onto the inner sides 22*a* and 23*a* of the heating mold by the inflated pressing member 11 whereby the profile of the inner sides 22*a* and 23*a* of the heating mold is transferred to the preform 30. Thus, however complicated the configuration of the inner sides 22*a* and 23*a* of the heating mold may be, the configuration of the inner sides 22*a* and 23*a* of the heating mold can be transferred to the preform 30 with good precision.

The fluids to be fed include gases, such as air, nitrogen and argon, liquids such as silicone oil, hydrocarbon oil and paraffin, and solids such as glass beads, alumina beads, and sand. The pressure for fluid feed is usually 0.01 to 5 MPa, particularly 0.1 to 3 MPa. Under a pressure lower than 0.01 MPa, the fluid may fail to press the preform 30 to the inner sides 22*a* and 23*a* of the heating mold. Under a pressure exceeding 5 MPa, the preform 30 may be collapsed by the fluid.

The preform 30 is then pressed, dehydrated and dried. As shown in FIG. 5(*c*), the fluid is withdrawn from the pressing member 11, whereby the pressing member 11 made of an elastic body shrinks to its original size. As shown in FIG. 5(*d*), the shrunken pressing member 11 is taken out of the heating mold 22, 23, the heating mold 22, 23 is opened, and the unitary pulp molded hollow container 12 is removed. The resulting pulp molded hollow container 12 is made thicker at the joints 9 and therefore has enhanced strength as shown in FIG. 5(*e*).

According to the above-described embodiment, the pulp deposited bodies formed by papermaking on the respective halves of the split mold can be combined easily because they are joined in the pulp slurry, or, they are joined while wet after being pulled out of the pulp slurry with the water content of at least the joint edges thereof adjusted as described above. Since the mold is split, a cavity having a complicated shape can be formed. Therefore, pulp molded hollow containers of various shapes can be produced with no restrictions on the designs. The molded article can easily be removed from the split mold without requiring a papermaking net as used in the conventional technique, and large-sized equipment is unnecessary.

While the pulp deposited bodies 7 and 8 are joined immediately after the formation, they may be joined after being dried. In this case, it goes without saying that the water content of the joint edges should range from 40 to 95 wt %.

While an elastic pressing member 11 is used in the above-described embodiment, a hollow bag may be used as the pressing member 11. In this case, after withdrawal of the fluid, the bag is evacuated to shrink and then taken out of the heating mold as shown in FIG. 5(*c*). Or, the bag is not taken out, remaining as a liner of the preform 30 thereby to provide a pulp molded hollow container excellent in waterproofness, moistureproofness, and gas barrier properties. The pressurizing fluid may be fed directly into the preform 30 without using the pressing member 11.

A cold parison (so-called preformed parison) comprising a thermoplastic resin may be used as the pressing member 11. Production using a cold parison is explained below briefly. The step up to completion of papermaking is the same as in the aforementioned embodiment so that the explanation therefor is omitted here.

Figure 6:
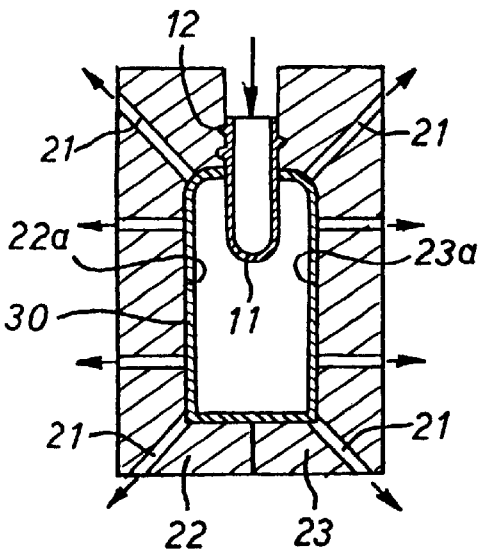
FIG. 6(*a*), FIG. 6(*b*) and FIG. 6(*c*) are cross sectional views showing, in sequence, the steps of inserting a hollow cold parison (so-called preformed parison) into the cavity of the closed split mold, inflating the cold parison, and pressing the pulp deposited body onto the inner wall of the mold by the inflated cold parison to dry the pulp deposited body to produce a pulp molded hollow container.
Figure 6:
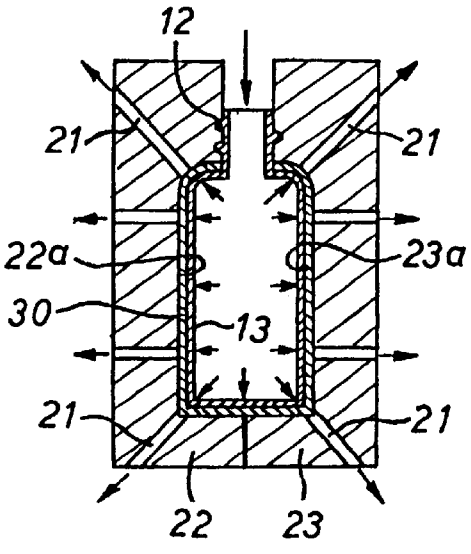
Figure 6:
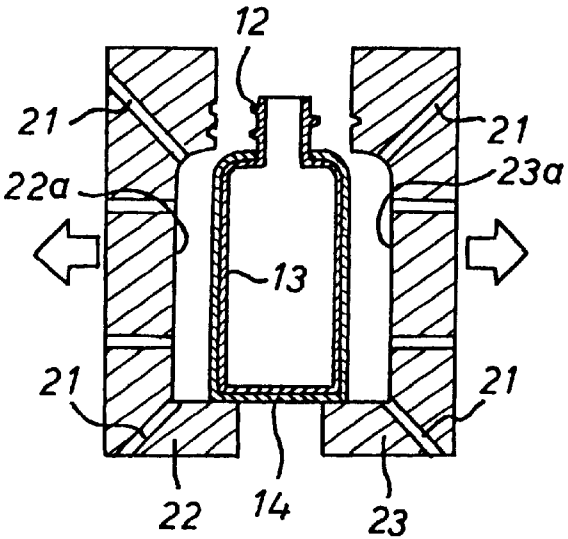

A hollow cold parison having screw threads 12 at the opening is inserted as a pressing member 11 into the cavity of the heating mold 22, 23 as shown in FIG. 6(*a*). The cold parison to be inserted has been heated so that it may be inflated by blowing a heated fluid. Examples of preferred thermoplastic resins are polyethylene (PE), polypropylene (PP), and polyethylene terephthalate (PET). The heating temperature is preferably 120 to 140° C. for PP or 100 to 130° C. for PET.

As shown in FIG. 6(*b*), a pressurizing fluid is fed into the pressing member 11 to inflate it, and the preform 30 is pressed onto the inner sides 22*a* and 23*a* of the heating mold by the inflated pressing member 11 whereby the preform 30 is pressed, dehydrated and dried. The pressurizing gas blown into the pressing member 11 can be of those useful in the above-described embodiment.

As shown in FIG. 6(*b*), the preform 30 is pressed onto the inner sides 22*a* and 23*b* of the heating mold by the inflated pressing member 11, and the shape of the cavity on the inner sides 22*a* and 23*a* of the heating mold is transferred while the preform 30 is dehydrated and dried. At the same time, a thermoplastic resin film 13 made of the inflated cold parison is formed in intimate contact. In this method, since lining of the preform 30 with the thermoplastic resin film 13 can be achieved simultaneously with drying and dehydration, the production process can be simplified, the productivity can be improved, and the cost is reduced.

After the pressurizing fluid is withdrawn from the pressing member 11, the heating mold 22, 23 is opened, and a pulp molded hollow container 14 lined with the thermoplastic resin film 13 is taken out as shown in FIG. 6(*c*). The thus prepared pulp molded hollow container 14 is, being lined with the thermoplastic resin film 13, excellent in waterproofness, moistureproofness, and gas barrier properties and can be used for putting liquids as well as powders in.

A second embodiment will be described. Only the particulars different from the first embodiment will be explained. To the same particulars is appropriately applied the description about the first embodiment.

In this embodiment, a net layer composed of a coarse mesh and a fine mesh is put on the surface of the splits 2 and 3 of a split mold for papermaking, and pulp fiber is deposited on the net layer. In detail, the net layer is composed of a first mesh and a second mesh that is finer than the first mesh. The first mesh is tightly put on the splits 2 and 3, and the second mesh is put on the first mesh. Alternatively a net layer composed of a first mesh and a second mesh that is finer than the first mesh is used, and the first mesh is tightly put on the splits 2 and 3, and the second mesh is formed on the first mesh. With the fine second mesh put on the coarse first mesh, or with the fine second mesh formed on the coarse first mesh, the number of the interconnecting holes 1 to be bored in the splits 2 and 3 can be decreased, and the pulp deposited bodies 7 and 8 can be accumulated with a uniform thickness. Further, the inner and the outer wall of the pulp deposited bodies can be made smooth, and the pulp deposited bodies can be taken out of the split mold 2, 3 more easily.

The first mesh and the second mesh form a coarse net layer and a fine net layer, respectively, and are in tight contact with the surface contour of the splits 2 and 3. Each of the first mesh and the second mesh is made of a natural material, a synthetic resin or a metal or a combination thereof. The net layers can be given a surface modifying coat to improve the slip properties, heat resistance, and durability. The natural materials include plant fibers and animal fibers. The synthetic resins include thermoplastic resins, thermosetting resins, regenerated resins, and semi-synthetic resins.

The average maximum opening width of the first mesh is preferably 1 to 50 mm, particularly 5 to 10 mm. The term "opening width" means the distance between lines of the first mesh.

The average opening area ratio of the first mesh is preferably 30 to 95%, particularly 75 to 90%.

On the other hand, the average maximum opening width of the second mesh is preferably 0.05 to 1.0 mm, particularly 0.2 to 0.5 mm. The term "opening width" means the inner size between lines of the second mesh.

The average opening area ratio of the second mesh is preferably 30 to 90%, particularly 50 to 80%.

In the present embodiment, a net having an average maximum opening width of 3 to 6 mm, an average opening area ratio of 80 to 92%, and a line width of 0.3 mm in the state covering the splits 2 and 3 was used as the first mesh. Such a first mesh has an average maximum opening width of 0.08 to 0.25 mm, an average opening area ratio of 46%, and a line width of 0.12 mm in the state before being put on the splits 2 and 3. A stocking having an average maximum opening width of 0.22 to 0.35 mm, an average opening area ratio of 58 to 69%, and a line width of 0.06 to 0.07 mm in the state covering the splits 2 and 3 was used as the second mesh. Such a second mesh has an average maximum opening width of 0.38 to 0.42 mm, an average opening area ratio of 75 to 75%, and a line width of 0.05 to 0.06 mm in the state before being put on the splits 2 and 3. It is desirable that the second mesh be rigid to such an extent that it does not come into contact with the surface of the split through the openings of the first mesh when the inside of the split is evacuated.

Figure 7:
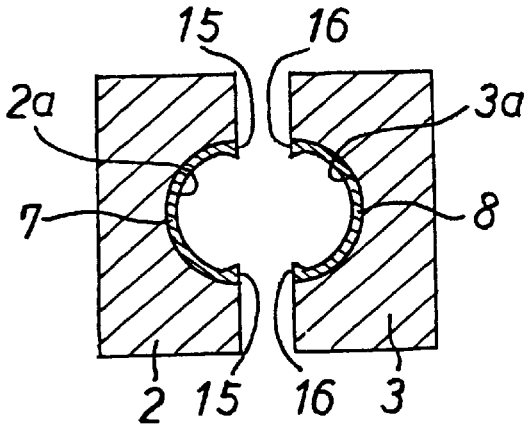
FIG. 7(*a*) and FIG. 7(*b*) show the state of pulp deposited bodies being joined together with their butt joints having an increased thickness, wherein FIG. 7(*a*) is a transverse section showing the state before split mold closure, and FIG. 7(*b*) is a transverse section showing the state of the closed split mold.
Figure 7:
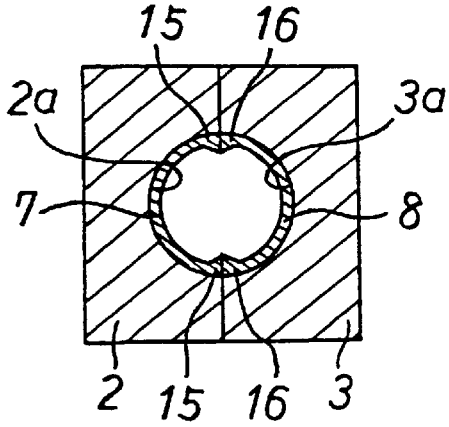
Figure 7:
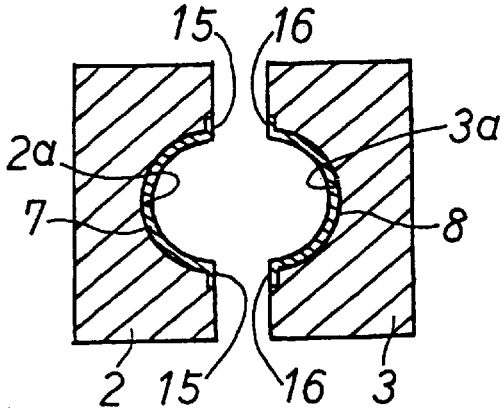

While the present invention has been described with reference to specific embodiments thereof, the present invention is not deemed to be limited thereto. For example, the mating edges 15 and 16 of both the pulp deposited bodies 7 and 8 may be thicker than the other parts as shown in FIGS. 7(*a*) and 7(*b*). The mating edges 15 and 16 of the pulp deposited bodies 7 and 8 can be made thicker by localized evacuation or enhanced evacuation in which these parts are evacuated for a longer time or more intensely than the other parts. Further, the mating edges 15 and 16 of the pulp deposited bodies 7 and 8 may project outward to increase the joint area of the pulp deposited bodies 7 and 8 as illustrated in FIG. 7(*c*). The projected parts 15 and 16 may be thinner than the pulp deposited bodies 7 and 8. In this case, the projected edged are cut away after joining. In this way, the pulp deposited bodies 7 and 8 can be joined more easily, and the joint strength will be enhanced. If necessary, the joints may be trimmed by a prescribed means to improve the appearance of the resulting hollow container.

The step of pressing, dehydrating and drying the hollow container preform 30 in a heating mold 22, 23 may be replaced with the step of pressing the preform 30 onto the inner wall of an unheated mold having a prescribed cavity shape to press and dehydrate the preform, which is followed by the step of separately drying the preform 30.

While papermaking on the splits 2 and 3 is followed by closing the splits 2 and 3 to join the pulp deposited bodies 7 and 8, the pulp deposited bodies 7 and 8 formed by papermaking may be once taken out of the split mold 2, 3 and transferred to another split hot pressing mold, and the splits of the hot pressing mold are closed to join the pulp deposited bodies 7 and 8.

While each of the splits 2 and 3 has a single cavity, the splits may be designed to form a plurality of pulp deposited bodies 7 and a plurality of pulp deposited bodies 8, respectively, at prescribed intervals so that a plurality of pulp deposited bodies may be made in a single mold.

It is also possible that papermaking is conducted by use of a single mold having two cavities which are connected to each other at a part, and the mold is folded at the connecting part to join the two pulp deposited bodies. By use of this mold, two halves of a pulp deposited body sharing one side are obtained.

While the pair of removable auxiliary molds 4 and 4 are provided on one of the splits (split 2), such a pair of removable auxiliary molds 4 and 4 may be provided on both of the splits 2 and 3.

While the set of splits used in the above embodiments comprise two halves, three or more splits can be used as a set in accordance with the shape of a desired molded article. The same applies to the heating mold shown in FIGS. 5 and 6.

While the above-described embodiments relate to production of bottle containers, the method of production according to the present invention is applicable to production of containers having other shapes, such as cartons and the like.

Industrial Applicability

As is apparent from the foregoing, the present invention provides a method of producing pulp molded hollow containers by which a pulp molded article having a complicated shape with a uniform wall thickness can be manufactured without requiring large-sized equipment and with ease in removing the molded article from the mold and also provides pulp molded hollow containers.

What is claimed is:

1. A method for producing a pulp molded article comprising the steps of depositing pulp fiber on the surfaces of a set of splits for papermaking having a plurality of interconnecting holes connecting the outside and the inside thereof to form a pulp deposited body on each split under such a state that said splits are separated from each other;

closing said splits to join said pulp deposited bodies together to form a joined body of said pulp deposited bodies; and feeding a fluid into a pressing member in said joined body to press said joined body onto the inner surface of a mold the cavity of which has a prescribed shape to make said joined body dry.

2. The method for producing a pulp molded article according to claim 1, wherein at least one of said splits is designed to form a joint part at at least a part of the mating edges of said pulp deposited body.

3. The method for producing a pulp molded article according to claim 1, wherein said joined body is dehydrated prior to drying.

4. The method for producing a pulp molded article according to claim 1, wherein said mold is a heating mold.

5. The method for producing a pulp molding article according to claim 1, wherein a net layer composed of a coarse mesh and a fine mesh is put on the surface of said splits, and pulp fiber is deposited on said net layer to form said pulp deposited body.

6. The method for producing a pulp molded article according to claim 1, wherein said mold is separately prepared from said splits.

7. The method for producing a pulp molded article according to claim 1, wherein said pulp fibers are deposited in such a manner that said pulp deposited bodies have a mating edge projecting outward.

8. The method for producing a pulp molded article according to claim 1, wherein said pressing step further comprises evacuating said mold through said interconnecting holes, thereby pressing said joined body against the inner surface of the mold, and thereby drying said joined body.

9. The method for producing a pulp molded article according to claim 1, wherein said fluid is a gas.

10. The method for producing a pulp molded article according to claim 1, wherein said fluid is a flowable solid particle.

11. The method for producing a pulp molded article according to claim 1, wherein said closing step comprises closing said splits to join said pulp deposited bodies together to form a joined body while said splits are immersed in a pulp slurry.

12. The method for producing a pulp molded article according to claim 1, further comprising deflating and withdrawing said pressing member from said joined body.

13. The method for producing a pulp molded article according to claim 1, wherein said pulp fibers are deposited so that said pulp deposited bodies have a mating edge that is thicker than other parts of said pulp deposited bodies.

14. The method according to claim 1, wherein the joined body has a thickness between approximately 0.5 mm to approximately 10.0 mm.

15. The method according to claim 1, wherein the depositing step further includes evacuating the set of splits in a pulp slurry.

16. The method according to claim 15, wherein the evacuating is performed at a pressure between approximately 100 Torr to approximately 600 Torr.

17. The method according to claim 1, wherein the water content of the joined body is between approximately 40 wt % and about 95 wt %.

18. The method according to claim 1, wherein the pressing member includes at least one of a natural rubber, a synthetic rubber, a thermoplastic elastomer, a urethane, a fluororubber, and a silicone rubber.

19. A method for producing a pulp molded article, comprising:

depositing pulp fiber on the surfaces of a set of splits for papermaking having a plurality of interconnecting holes connecting the outside and inside of the set of splits to form a pulp deposited body on each split when the splits are separated from each other in a pulp slurry;

closing the splits to join the pulp deposited bodies together to form a joined body of the pulp deposited bodies while the pulp deposited bodies are in the pulp slurry; and feeding a fluid into a pressing member in the joined body to press the joined body onto the inner surface of a mold, the cavity of which has a prescribed shape to make the joined body dry.

20. The method according to claim 19, wherein the joined body has a thickness between approximately 0.5 mm to approximately 10.0 mm.

21. The method according to claim 19, wherein the depositing step further includes evacuating water from the set of splits in a pulp slurry.

22. The method according to claim 21, wherein the evacuating is performed at a pressure between approximately 100 Torr to approximately 600 Torr.

23. The method according to claim 19, wherein the water content of the joined body is between approximately 40 wt % and about 95 wt %.

24. The method according to claim 19, wherein the pressing member includes at least one of a natural rubber, a synthetic rubber, a thermoplastic elastomer, a urethane, a fluororubber, and a silicone rubber.

25. The method for producing a pulp molded article according to claim 19, wherein at least one of the splits is designed to form a joint part at at least a part of the mating edges of the pulp deposited body.

26. The method for producing a pulp molded article according to claim 19, wherein the joined body is dehydrated prior to drying.

27. The method for producing a pulp molded article according to claim 19, wherein the mold is a heating mold.

28. The method for producing a pulp molding article according to claim 19, wherein a net layer composed of a coarse mesh and a fine mesh is put on the surface of the splits, and pulp fiber is deposited on the net layer to form the pulp deposited body.

29. The method for producing a pulp molded article according to claim 19, wherein the mold is separately prepared from the splits.

30. The method for producing a pulp molded article according to claim 19, wherein the pulp fibers are deposited in such a manner that the pulp deposited bodies have a mating edge projecting outward.

31. The method for producing a pulp molded article according to claim 19, wherein the pressing step further comprises evacuating the mold through the interconnecting holes, thereby pressing the joined body against the inner surface of the mold, and thereby drying the joined body.

32. The method for producing a pulp molded article according to claim 19, wherein the fluid is a gas.

33. The method for producing a pulp molded article according to claim 19, wherein the fluid is a flowable solid particle.

34. The method for producing a pulp molded article according to claim 19, further comprising deflating and withdrawing the pressing member from the joined body.

35. The method for producing a pulp molded article according to claim 19, wherein the pulp fibers are deposited so that the pulp deposited bodies have a mating edge that is thicker than other parts of the pulp deposited bodies.

* * * * *

UNITED STATES PATENT AND TRADEMARK OFFICE

CERTIFICATE OF CORRECTION

PATENT NO. : 6,645,348 B2
DATED : November 11, 2003
INVENTOR(S) : Kumamoto et al.

It is certified that error appears in the above-identified patent and that said Letters Patent is hereby corrected as shown below:

Title page,
Item [*] Notice, should read:
-- (*) Notice: Subject to any disclaimer, the term of this patent is extended or adjusted under 35 U.S.C. 154(b) by 0 days. --

Signed and Sealed this

Thirtieth Day of December, 2003

JAMES E. ROGAN
*Director of the United States Patent and Trademark Office*